US005274711A

United States Patent [19]

Rutledge et al.

[11] Patent Number: 5,274,711

[45] Date of Patent: *Nov. 28, 1993

[54] APPARATUS AND METHOD FOR MODIFYING A SPEECH WAVEFORM TO COMPENSATE FOR RECRUITMENT OF LOUDNESS

[76] Inventors: Janet C. Rutledge, 1211 Grant St., Evanston, Ill. 60201; Mark A. Clements, 5576 Mountainbrooke Ct., Stone Mountain, Ga. 30087

[*] Notice: The portion of the term of this Patent subsequent to 06/21/2008 has been disclaimed.

[21] Appl. No.: 436,428

[22] Filed: Nov. 14, 1989

[51] Int. Cl.[5] ..... G10L 5/00

[52] U.S. Cl. ..... 381/47; 381/46; 381/48; 381/68.2; 381/68.4

[58] Field of Search ..... 382/48, 46, 47, 68.2, 382/68.4

[56] References Cited

U.S. PATENT DOCUMENTS

| | | | |
|---|---|---|---|
| 4,099,035 | 7/1978 | Yanick | 381/68.2 |
| 4,508,940 | 4/1985 | Steeger | 381/68.2 |
| 4,860,360 | 8/1989 | Boggs | 381/48 |

*Primary Examiner*—Emanuel S. Kemeny
*Attorney, Agent, or Firm*—John L. James; Michael V. Drew

[57] ABSTRACT

An apparatus and method for modifying a speech waveform using sinusoidal speech model parameters, includes finding a net masked threshold for each sinusoid for a normal-hearing subject, and adding the effects of impairment and obtaining an impaired masked threshold. The method also includes finding gain needed for each sinusoid so that its distance above the impaired masked threshold is equal to the distance above normal masked threshold, and multiplying sinusoid amplitudes by the gain. The sinusoidal model is used to address the problem of spread of masking within internal speech components by determining the amount of masking that occurs between surrounding sinusoids. The masked threshold for each sinusoid is determined based on the additive effects of masking by other sinusoids in each frame. The method compensates for recruitment by a transformation to determine how much each sinusoidal amplitude must be amplified in order to maintain the loudness relationships between sinusoids and their masked threshold in the normal-hearing and hearing-impaired domains.

11 Claims, 3 Drawing Sheets

APPARATUS AND METHOD FOR MODIFYING A SPEECH WAVEFORM TO COMPENSATE FOR RECRUITMENT OF LOUDNESS

TECHNICAL FIELD

This invention relates generally to an apparatus and method for processing signals, and more particularly, to a hearing aid apparatus and method for enhancing a speech signal to make speech more intelligible for hearing impaired persons, especially those having a sensorineural impairment with recruitment of loudness.

BACKGROUND OF THE INVENTION

Many people have hearing impairments that decrease their quality of life. Most hearing impairments may be classified as one of two kinds, conductive or sensorineural. Conductive hearing losses are typically caused by a malfunction of the middle ear which interferes with the acoustic transmission of sound to the sense organ of the ear. A simulation of this kind of hearing loss is the reduced level of sound a person experiences when wearing ear plugs. The person's auditory processing system functions, but less than all of the sound is conducted to the sensory portions of the ear so that everything sounds quieter. In other cases the incoming sounds may be mechanically filtered by a frequency selective process. Generally, if a listener with a conductive loss is allowed to adjust the gain of a speech signal to his most comfortable level, speech intelligibility is almost normal.

Sensorineural hearing losses refer to an abnormality of the sense organ, the auditory nerve, or both. In these impairments, significant speech degradation persists despite adjustments to gain. Recruitment of loudness is one type of sensorineural impairment that affects the sense organ.

Loudness is an aspect of the sensation obtained by listening directly to a sound and is measured by the responses of a human observer. Intensity, on the other hand, is related to the power of the acoustic signal as measured by instruments. Loudness perception, unlike intensity, varies from person to person and with frequency. With recruitment of loudness, the loudness sensation of a tone grows more rapidly with an increase in physical intensity than it does in the normal ear.

Recruitment of loudness has the effect on speech perception of expanding the difference in perceived loudness between high amplitude vowels and low amplitude consonants. This effectively gives high frequency attenuation even if a listener's impairment does not become greater at high frequencies. With recruitment of loudness, the impaired subject has a reduced dynamic range of hearing that causes some conversational speech to fall below the subject's elevated threshold of hearing. It is often especially pronounced in the high frequency region where much of the information needed for consonant recognition is contained. If sufficient amplification to boost the high frequencies above the subject's threshold is provided, higher amplitude consonants would reach or exceed the discomfort level.

The phenomena described for recruitment of loudness are similar to those of speech masked by noise or other sounds. A sound is masked when it cannot be heard due to the presence of another sound. When a tone is just below the level of a masking noise it sounds very faint, but with just a small increase in its intensity, the loudness of the tone can be increased greatly. The phenomenon of the effects of a masker appearing beyond the frequency band of the masker is termed spread of masking. A person with sensorineural hearing loss will experience a greater than normal spread of masking which leads to masking between individual speech components.

The effects of masking have been studied for sinusoids and narrowband noise makers. Each masker can mask a region of the spectrum. The shape of the region differs for persons with sensorineural hearing impairments in direct relation to the amount of spread of masking. When more than one masker is present, the masking effects add whether the maskers are nonoverlapping, partially overlapping or totally overlapping.

Recruitment has not been successfully treated with currently available hearing aids. Typical hearing aids primarily amplify sounds so that the unaffected portions of the sense organ can be stimulated. The types of distortions associated with recruitment are often made worse with straight amplification. Accordingly, it will be appreciated that it would be highly desirable to have a signal processing apparatus and method that is nonlinear.

Amplication with some form of amplitude limiting has been used in hearing aids to bring speech and other sounds within the subject's reduced dynamic range of hearing. These techniques include linear amplification with automatic gain control, single channel compression where overall levels are compressed, and multichannel compression where compression is performed separately in different frequency regions. Each of these techniques have operated directly on the speech waveform and achieved limited success. Accordingly, it will be appreciated that it would be highly desirable to have a signal processing method that gives satisfactory results without operating directly on the speech waveform.

The perception of sound by persons having recruitment has been described as being equivalent to listening through a volume expander followed by an attenuator. A system employing amplitude expansion and attenuation has been used to simulate recruitment of loudness. Therefore, for compensation of recruitment, compression plus equalization was applied. Various types of compression systems have been developed including wideband and multiband compression. Multiband syllabic compression systems reduce the variation in speech level in each frequency band according to the subject's reduced dynamic range in that band. Single channel (wideband) systems process the entire speech signal on the basis of overall level. Although wideband processing cannot match a person's hearing profile as well as multiband processing, wideband processing does not distort the short term spectral shape.

The wideband and multiband compression systems mostly use digital or analog filters along with equalization gain. With these systems, the parameters remain constant over time, regardless of the input conditions. Linear amplification minimizes distortion and, with the use of automatic gain control, these systems can cause speech to remain below the subject's threshold of discomfort. However, automatic gain control systems, even with frequency-dependent gain, cannot adjust quickly to input transients and may cause some components to fall below threshold if high amplitude components are present.

In the past, both linear and compressive systems used parameters that remained fixed with time. Compressive systems did not change with input level and automatic gain control systems responded too slowly to input changes.

Multiband filter compression distorts the short-term spectral shape. Prior systems also ignored the spread of masking phenomenon. Accordingly, it will be appreciated that it would be highly desirable to have an apparatus and method that takes into account the spread of masking phenomenon and which adjusts quickly to transients.

SUMMARY OF THE INVENTION

The present invention is directed to overcoming one or more of the problems set forth above. Briefly summarized, according to the present invention, a method for modifying a speech waveform using sinusoidal speech model parameters, includes finding a net masked threshold for each sinusoid for a normal-hearing subject, and adding the effects of impairment and obtaining an impaired masked threshold. The method also includes finding gain needed for each sinusoid so that its distance above the impaired masked threshold is equal to the distance above normal masked threshold, and multiplying sinusoid amplitudes by the gain.

According to another aspect of the present invention, an apparatus for modifying a speech waveform includes means for performing a sinusoidal model analysis on the speech waveform and obtaining magnitude, frequency and phase speech parameters, and means for determining a net masked threshold for each sinusoid for a normal-hearing subject, determining the distance each sinusoid is above its net masked threshold, and adding the effects of impairment and obtaining an impaired masked threshold. The apparatus determines the gain needed for each sinusoid so that its distance above the impaired masked threshold is equal to the distance above normal masked threshold, multiplies sinusoid amplitudes by the gain and recombines the parameters according to sinusoidal model overlap-add synthesis.

It is an object of the present invention to provide a signal processor using a sinusoidal speech model that allows compensation to vary with both time and frequency.

Another object of the invention is to solve a set of nonlinear equations to determine the best gain coefficient for each sinusoidal component in each frame of speech based on a model of the hearing impaired person's masking profile.

The present invention compensates for spread of masking and recruitment in sensorineural hearing losses by amplifying each sinusoidal amplitude to maintain the overall relationship between the sinusoids and their masked thresholds present in the normal-hearing domain. It determines the masked threshold for each sinusoid based on the additive effects of masking by the other sinusoids present in each frame and sets up a transformation to determine how much each sinusoidal amplitude must be amplified in order to maintain the overall relationships between the sinusoids and their masked threshold based on the shape of the masking region for the impaired subject. The net result is similar to the effects of compression with equalization.

Another object of the invention is to provide a signal processor that adapts nonlinearly to changing properties of the speech signal in addition to the frequency characteristics of the person's residual hearing.

Still another object of the invention is to provide a signal processor that avoids distortions inherent in multichannel filtering techniques.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
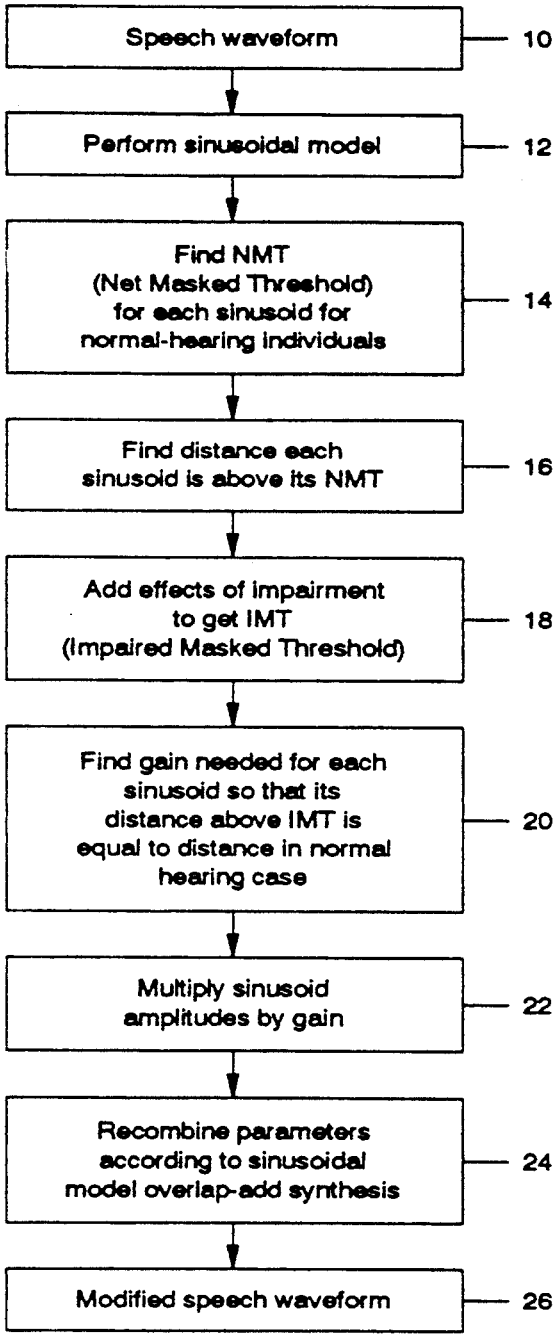
FIG. 1 is a simplified flow chart of a preferred embodiment of a speech enhancer according to the present invention.

Referring to FIG. 1, a method for enhancing speech to compensate for hearing impairments includes receiving a speech waveform at block 10 of the flowchart. A sinusoidal model analysis of the speech waveform is performed at block 12 to obtain speech parameters such as frequency, phase and amplitude. At block 14, the net masked threshold is determined for each sinusoid for normal-hearing individuals. Then determining, at block 16, the distance each sinusoid is above its net masked threshold. At block 18, the effects of hearing impairment are added to obtain the impaired masked threshold. The next step at block 20 is to determine the gain needed for each sinusoid so that its distance above the impaired masked threshold is equal to the distance in the normal-hearing subject. Once the gain is determined, then the sinusoid amplitudes are multiplied by the gain at block 22, and at block 24, the parameters are recombined according to sinusoidal model overlap-add synthesis. This yields a modified speech waveform at block 26.

The present invention basically determines a pre-processing operator that acts on a signal that will undergo a known distortion. It involves a method to compensate for the distortion that takes place in the ear as a result of the hearing impairment known as recruitment of loudness. This is somewhat the inverse of the problem of restoring a distorted signal. The sinusoidal speech model is used to develop a time-varying, frequency-dependent method to compensate for recruitment of loudness. The method incorporates a psychoacoustic model of the interaction of sinusoidal masking in normal hearing and hearing impaired individuals. The result is similar to multichannel compression system with as many channels as there are sinusoids in that frame. The time-varying gain allows the processing to adapt to the fluctuations in the input speech.

The general problem of restoring a signal that has been distorted can be represented by the equation: $y=Dx$, where y is a known output, D is a known distortion operator, and x is an unknown input. The problem is to find $x=D^{-1}y$. When it is known that a signal will undergo a distortion D, the pre-processing operator $D^*$ can be found such that $D[D^*x]=\hat{x}$, where $\hat{x}\approx x$. In the hearing impaired, D represents the distortion that takes place in the ear with recruitment of loudness hearing impairment. This can be modeled, to a first order, as internal noise masking. D* is the pre-processing done by the hearing aid or other device. Because $D^{-1}$ may not exist, it is necessary to use an indirect procedure to find D*.

The sinusoidal model represents speech as the sum of sinusoids with various amplitudes, frequencies and phases. The modelling is independent of voicing state and pitch period. Speech is sampled and windowed into frames of a 20 millisecond duration. A 512 point discrete Fourier transform is performed. The magnitudes, frequencies and phases of the largest peaks of the frequency spectrum, to a maximum of 80, are chosen as parameters. The parameters are modified to compensate for the effects of the hearing impairment. Upon re-synthesis, the parameters are recombined according to the equation:

$$s(n) = \sum_{l=1}^{L(k)} A_l \cos\theta_l(n)$$

where L(k) is the number of peaks in frame k, $A_l$ is the peak amplitude, and $\theta_l(n)$ is the instantaneous phase. Linear interpolation from frame to frame is used to ensure smooth transitions at each boundary. The sinusoidal model produces little perceivable distortion and characteristics of sinusoids are better understood than those of other waveforms. It is easier to trace the effects of processing on sinusoids than on broadband signals such as speech.

Listeners with sensorineural hearing impairments experience not only elevated thresholds but an abnormal spread of masking. This excess masking can be modeled by assuming two masking sources that add, one internal resulting in elevated thresholds, and one external due to the acoustic stimulus. The elevated quiet thresholds that occur with the impairment can be modeled as the result of increased internal masking noise.

In many cases the combined effect of two maskers is not equal to the simple sum of the individual effects, but is known to take place according to the relation $$X_{j+k} = (X_j^{\frac{1}{3}} + X_k^{\frac{1}{3}})^3,$$

where $X_j$ and $X_k$ are the individual masking effects of the maskers in intensity units and $X_{j+k}$ is the combined effect.

The sinusoidal model is used to address the problem of internal masking within speech components in persons having a sensorineural loss by determining the amount of masking that occurs between surrounding sinusoids. For each sinusoid the net masking provided by surrounding sinusoids is viewed as the external masking source. When combined with the impaired subject's quiet threshold, the total impaired masked threshold is found for the target sinusoid. The sinusoid must be above this combined threshold to be audible to the impaired listener.

The masking additivity model can be extended to an arbitrary number of masking sources. The number of sinusoids that provide masking to the target sinusoid varies with each target. Only those sinusoids within a critical band around the target sinusoid are modeled to have any contribution toward the masked threshold for that sinusoid. The size of a critical band increases with frequency, however it is approximately constant on an octave scale.

Figure 2:
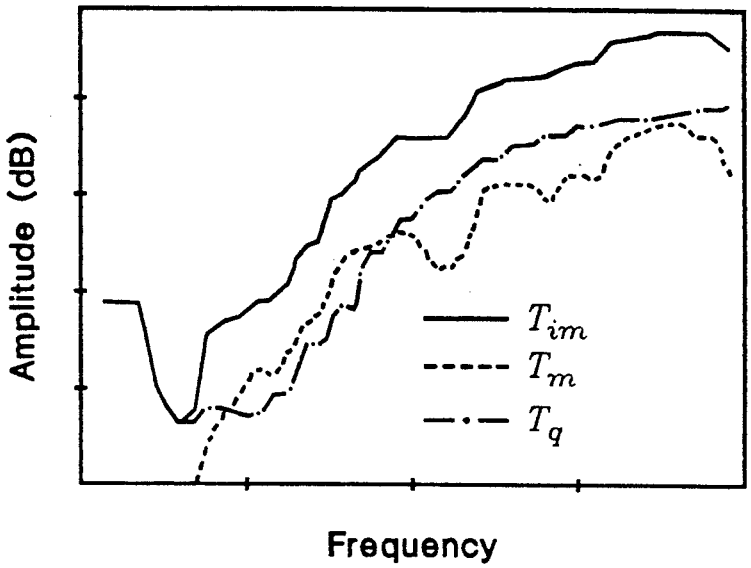
FIG. 2 is a graph showing the relationship between the impaired masked threshold, impaired quiet threshold and net masked threshold.

Mathematically, the net masked threshold for each sinusoidal component is determined by $$T_m^{\frac{1}{3}}(i) = F(\omega_j,\omega_i)Lj + F(\omega_k,\omega_i)L_k +$$

where $T_m(i)$ is the net masked threshold for sinusoid i in intensity units and $F(\omega_j, \omega_i)Lj$ corresponds to $X_j^{\frac{1}{3}}$ in the equation above. $F(\omega_j, \omega_i)$ denotes the amount of masking that a sinusoid at frequency $\omega_j$ would produce on a sinusoid at frequency $\omega_i$. Lj is proportional to the cube root of the intensity of sinusoid j and represents the perceived loudness of that sinusoid. This equation can be extended to any number of sinusoids that interact. Using the internal/external masking model for the hearing loss, the impaired masked threshold can be approximated by $$T_{im}^{\frac{1}{3}}(i) = T_m^{\frac{1}{3}}(i) + T_q^{\frac{1}{3}}(i),$$

where $T_q(i)$ is the impaired quiet threshold. The relationship between these three thresholds is illustrated in FIG. 2.

To compensate for the impairment, a model incorporating time-varying, frequency-dependent gain is used. The model determines the amount of gain needed to raise the sinusoidal amplitudes above the impaired masked threshold and takes into account the fact that boosting the amplitude of one sinusoid will elevate the threshold of others. Calculations are performed for each individual sinusoid during each speech frame.

A sinusoid must be above its net masked threshold in order to be heard by a normal hearing listener. In the case of two sinusoids, the distance above threshold is represented by $$\delta_1 = L_1 - F(\omega_2,\omega_1)L_2$$

$$\delta_2 = L_2 - F(\omega_1,\omega_2)L_1,$$

where $\delta_1$ is the distance is loudness units sinusoid i is above its masked threshold. For the impaired listener, the effects of the impaired quiet threshold must be added. If the loudness of the impaired threshold at frequency $\omega_1$ is represented by $$N_i = T_q^{\frac{1}{3}}(i),$$

then $$\delta_1 = L_1 - (F(\omega_2,\omega_1)L_2 + N_1)$$

$$\delta_2 = L_2 - (F(\omega_1,\omega_2)L_1 + N_2).$$

For recruitment it is assumed that the distance above threshold in the normal hearing case needs to be preserved. That way, all sinusoids audible to a normal hearing individual will also be audible to the impaired listener. In addition, this will help maintain the spectral relationships in terms of perceived loudness. The amount of loudness gain gj given to sinusoid j will affect the net masked threshold for sinusoid i. Therefore these gains must be computed simultaneously. Mathematically, $$\delta^*_1 = g_1L_1 - F_{21}g_2L_2 - N_1$$

$$\delta^*_2 = g_2L_2 - F_{12}g_1L_1 - N_2,$$

where $F_{21}=F(\omega_2,\omega_1)$. The goal is to find $\delta^*_1=\delta_1$ and $\delta^*_2=\delta_2$ which leads to the following system of equations:

$$g_1L_1-F_{21}g_2L_2-N_1=L_1-F_{21}L_2$$

$$g_2L_2-F_{12}g_1L_1-N_2=L_2-F_{12}L_1.$$

which yields:

$$g_1=(L_1+N_1)/L_1 \text{ and } g_2=(L_2+N_2)/L_2,$$

where $$N_1=\frac{N_1+N_2F_{21}}{1-F_{12}F_{21}} \text{ and } N_2=\frac{N_2+N_1F_{12}}{1-F_{12}F_{21}}.$$

For the m×m case where j does not equal i:

$$Li-\sum_{j=1 j\neq i}^{m} F(\omega_j,\omega_i)Lj=g_iLi-\sum_{j=1 j\neq i}^{m} F(\omega_j,\omega_i)g_jLj-Ni$$

or $$[I-F]Lg=[I-F]L\bar{1}+N$$

where $\bar{1}$ is the vector of all 1's and I is the identity matrix.

The solution is $\bar{g}=\bar{1}+L^{-1}[I-F]^{-1}\bar{N}$ which leads to $$g_i=\frac{L_i+N_i}{L_i}$$

as in the 2×2 case.

These gains are converted from loudness units to be used with sinusoidal amplitudes. Because loudness sums with the cube root of intensity, the gain for sinusoid i is $g_i^*=g_i^{3/2}$. Upon re-synthesis these gains $g_i^*$ are applied to the individual sinusoids before summing.

This general theory can be extended to the case of an infinite number of sinusoids in which the summations become integrals. The distance above masked threshold in the normal and impaired cases can be expressed as $$\delta(\omega)=L(\omega)-\int_0^{\omega_m} L(\nu)F(\nu,\omega)d\nu$$

$$\delta(\omega)=L(\omega)-\int_0^{\omega_m} L(\nu)F(\nu,\omega)d\nu-N(\omega),$$

where $\omega_m$ is the highest frequency value. The problem is then to solve the integral equation $$g(\omega)L(\omega)-\int_0^{\omega_m} g(\nu)L(\nu)F(\nu,\omega)d\nu-N(\omega)=L(\omega)-\int_0^{\omega_m} L(\nu)F(\nu,\omega)d\nu$$

to find the function $g(\omega)$. This reduces to a Fredholm equation of the second kind. If the triangular masking shape is assumed, leading to a separable kernel, the solution becomes $$g(\omega)=\frac{L(\omega)+N(\omega)+\frac{1}{c}\int_0^{\omega_m} N(\nu)F(\nu,\omega)d\nu}{L(\omega)}$$

where the term 1/c comes from the integral evaluated at $\nu=\omega$. This result parallels the discrete frequency solution.

Figure 3:
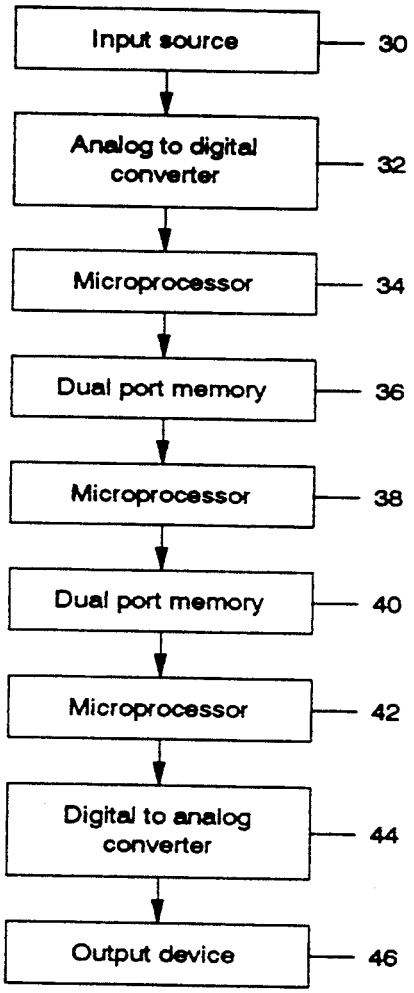
FIG. 3 is a block diagram of a preferred embodiment of a speech enhancer according to the present invention.

Referring now to FIG. 3, the method of the present invention is implemented using the apparatus depicted in the block diagram.

The input sound originates from a source 30 such as a telephone, television, microphone or other device. The input sound is converted to a digital signal by an analog to digital converter 32 and input to a microprocessor 34 which performs a sinusoidal analysis. Microprocessor 34 is coupled via dual port memory 36 to microprocessor 38.

The microprocessor 38 determines a net masked threshold for each sinusoid for a normal-hearing subject, determines the distance each sinusoid is above its net masked threshold, and adds the effects of impairment and obtains an impaired masked threshold. The microprocessor 38 also performs a portion of the task of finding the gain needed for each sinusoid so that its distance above the impaired threshold is equal to the distance above the normal masked threshold. Microprocessor 38 is coupled via dual port memory 40 to microprocessor 42 which completes determining the gain. In addition, microprocessor 42 multiplies the sinusoid amplitudes by the gain and recombines the parameters according to sinusoidal model overlap-add synthesis.

The modified speech signal is converted from a digital signal to an analog signal by digital to analog converter 44 and output to a device 46, such as a hearing aid, telephone, or other device.

It will now be appreciated that there has been presented a pre-processing operator that acts on a signal that will undergo a known distortion. The invention includes a computer implementation of a mathematical model designed to compensate for the effects of recruitment of loudness in sensorineural hearing impairments. The strength of this technique is that it operates on both a time-varying and frequency-dependent basis, and incorporates a model of the psychoacoustic masking of sinusoids in normal-hearing and hearing impaired individuals. The net effect is a combination between multichannel amplitude compression and automatic gain control because the compressive gains calculated separately for each frame of speech automatically adjust to the level of the speech components in that frame. The psychoacoustic model of inter-component sinusoidal masking approximately compensates for the effects of spread of masking and maintains spectral relationships.

The present invention improves upon present technology because it uses sinusoidal speech parameterization to improve flexibility and reduce distortion. It incorporates time-varying, frequency-dependent nonlinear gain that reduces the variations in speech level in a manner similar to multiband compression. It also automatically adjusts to the fluctuating amplitude of the input speech. It maintains the relative balance between spectral components in the normal-hearing and hearing impaired domains. The invention incorporates psychoacoustic relationships between sinusoidal masking in the normal-hearing and hearing impaired to address the problem of spread of masking.

While the invention has been described with reference to a digital hearing aid, it is apparent that the invention is easily adapted to other devices and uses. This invention could be used as the central processing portion in a digital hearing aid, whether it is wearable or serves to enhance a television, radio, telephone, public address system, or other electronic voice communication medium. While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

We claim:

1. A method for modifying a speech waveform using sinusoidal speech model parameters, comprising:

finding a net masked threshold for each sinusoid for a normal-hearing subject;

adding the effects of impairment and obtaining an impaired masked threshold;

finding gain needed for each sinusoid so that its distance above the impaired masked threshold is equal to the distance above normal masked threshold; and multiplying sinusoid amplitudes by said gain.

2. A method, as set forth in claim 1, including determining the net masked threshold for each sinusoidal component by the relationship $$T_m^{\frac{1}{3}}(i)=F(\omega_j,\omega_i)Lj+F(\omega_k,\omega_i)L_k+$$

where $T_m(i)$ is the net masked threshold for sinusoid i in intensity units, $F(\omega_j, \omega_i)$ denotes the amount of masking that a sinusoid at frequency $\omega_j$ would produce on a sinusoid at frequency $\omega_i$, and Lj is proportional to the cube root of the intensity of sinusoid j and represents the perceived loudness of that sinusoid.

3. A method, as set forth in claim 1, including approximating the impaired masked threshold by the relation $$T_{im}^{\frac{1}{3}}(i)=T_m^{\frac{1}{3}}(i)+T_q^{\frac{1}{3}}(i),$$

where $T_q(i)$ is the impaired quiet threshold.

4. A method, as set forth in claim 1, wherein the distance above threshold is represented by $$\delta_1=L_1-F(\omega_2,\omega_1)L_2$$

$$\delta_2=L_2-F(\omega_1,\omega_2)L_1,$$

where $\delta_1$ is the distance in loudness units sinusoid i is above its masked threshold.

5. A method, as set forth in claim 1, wherein the amount of loudness gain $g_i$ given to the sinusoid is $$g_i=\frac{L_i+N_i}{L_i}.$$

6. A method for modifying a speech waveform, comprising:

performing a sinusoidal model analysis on said speech waveform and obtaining magnitude, frequency and phase speech parameters;

finding a net masked threshold for each sinusoid for a normal-hearing subject;

finding the distance each sinusoid is above its net masked threshold;

adding the effects of impairment and obtaining an impaired masked threshold;

finding gain needed for each sinusoid so that its distance above the impaired masked threshold is equal to the distance above normal masked threshold;

multiplying sinusoid amplitudes by said gain; and recombining said parameters according to sinusoidal model overlap-add synthesis.

7. A method, as set forth in claim 6, including determining the net masked threshold for each sinusoidal component by the relationship $$T_m^{\frac{1}{3}}(i)=F(\omega_j,\omega_i)Lj+F(\omega_k,\omega_i)L_k+$$

where $T_m(i)$ is the net masked threshold for sinusoid i in intensity units, $F(\omega_j, \omega_i)$ denotes the amount of masking that a sinusoid at frequency $\omega_j$ would produce on a sinusoid at frequency $\omega_i$, and Lj is proportional to the cube root of the intensity of sinusoid j and represents the perceived loudness of that sinusoid.

8. A method, as set forth in claim 7, including approximating the impaired masked threshold by the relation $$T_m^{\frac{1}{3}}(i)=T_m^{\frac{1}{3}}(i)+T_q^{\frac{1}{3}}(i),$$

where $T_q(i)$ is the impaired quiet threshold.

9. A method, as set forth in claim 6, wherein the distance above threshold is represented by $$\delta_1=L_1-F(\omega_2,\omega_1)L_2$$

$$\delta_2=L_2-F(\omega_1,\omega_2)L_1,$$

where $\delta_1$ is the distance in loudness units sinusoid i is above its masked threshold.

10. A method, as set forth in claim 6, wherein the amount of loudness gain $g_i$ given to the sinusoid is $$g_i=\frac{L_i+N_i}{L_i}.$$

11. A apparatus for modifying a speech waveform, comprising:

first means for performing a sinusoidal model analysis on said speech waveform and obtaining magnitude, frequency and phase speech parameters;

second means for determining a net masked threshold for each sinusoid for a normal-hearing subject;

third means for determining the distance each sinusoid is above its net masked threshold;

fourth means for adding the effects of impairment and obtaining an impaired masked threshold;

fifth means for determining gain needed for each sinusoid so that its distance above the impaired masked threshold is equal to the distance above normal masked threshold; and sixth means for multiplying sinusoid amplitudes by said gain and recombining said parameters according to sinusoidal model overlap-add synthesis.

* * * * *